US005295819A

United States Patent [19]

Gómez López et al.

[11] Patent Number: 5,295,819

[45] Date of Patent: Mar. 22, 1994

[54] POCKET LIGHTER HAVING A SAFETY MECHANISM

[75] Inventors: Isidro Gómez López, Barcelona; Jorge Serrahima Formosa, Sant Cugat del Valles, both of Spain

[73] Assignee: Flamagas, S.A., Barcelona, Spain

[21] Appl. No.: 960,768

[22] Filed: Oct. 14, 1992

[30] Foreign Application Priority Data

Oct. 14, 1991 [ES] Spain ..... 9102256

[51] Int. Cl.[5] ..... F23D 11/36

[52] U.S. Cl. ..... 431/153; 431/277

[58] Field of Search ..... 431/140, 153, 275, 276, 431/277; 222/153

[56] References Cited

U.S. PATENT DOCUMENTS

| | | | |
|---|---|---|---|
| 2,588,479 | 3/1952 | Burchett et al. | 431/140 |
| 3,547,566 | 12/1970 | Tamarin et al. | 431/153 |
| 4,717,335 | 1/1988 | Loveless | 431/277 |
| 4,830,603 | 5/1989 | Cirami | 431/153 |
| 5,035,608 | 7/1991 | Parren | 431/153 |

FOREIGN PATENT DOCUMENTS

| | | |
|---|---|---|
| 0285748 | 10/1988 | European Pat. Off. . |
| 0291956 | 11/1988 | European Pat. Off. . |
| 0357347 | 3/1990 | European Pat. Off. . |
| 2645626 | 10/1990 | France . |
| 8902796 | 8/1989 | Spain . |

*Primary Examiner*—James C. Yeung

*Attorney, Agent, or Firm*—Scully, Scott, Murphy & Presser

[57] ABSTRACT

A pocket lighter having a safety mechanism, with a push button; a cavity in which part of the push button is housed; and a free body in the cavity, between the latter and the push button, and depending on the position of the push button there are defined spaces which may be occupied by the said free body, and passages between said spaces, through which the free body may pass. The latter, after the lighter has been ignited, occupies a first space in which it blocks operation of the push button and to remove it from the first space it is necessary to combine certain movements of the push button with others of the lighter; these movements are of sufficient complexity to make it impossible for a child to operate the lighter.

12 Claims, 5 Drawing Sheets

Fig. 1
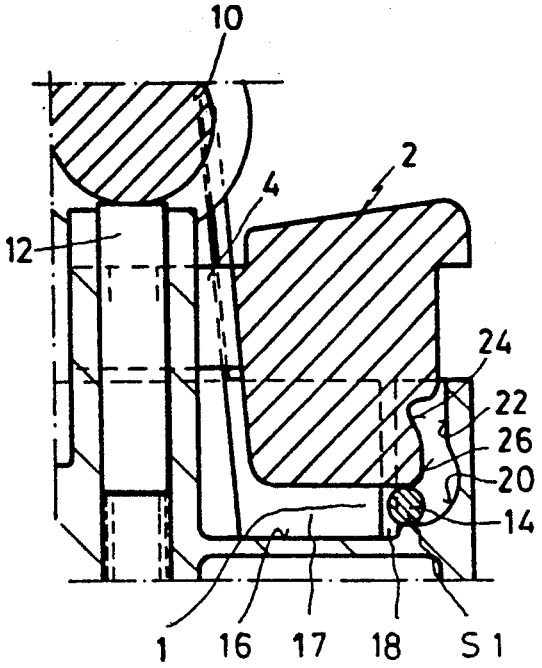
Fig. 2
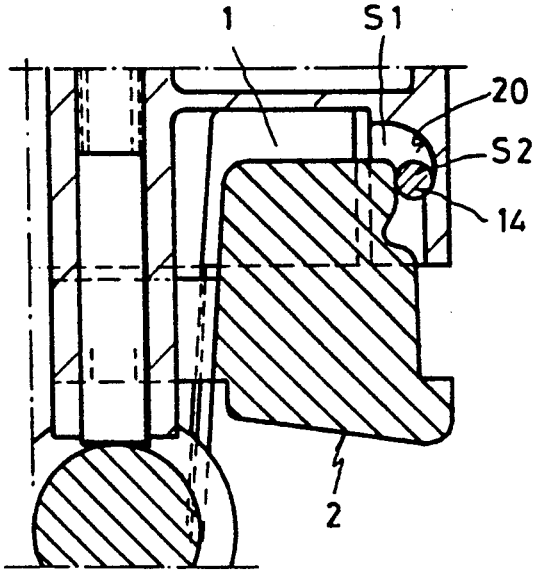
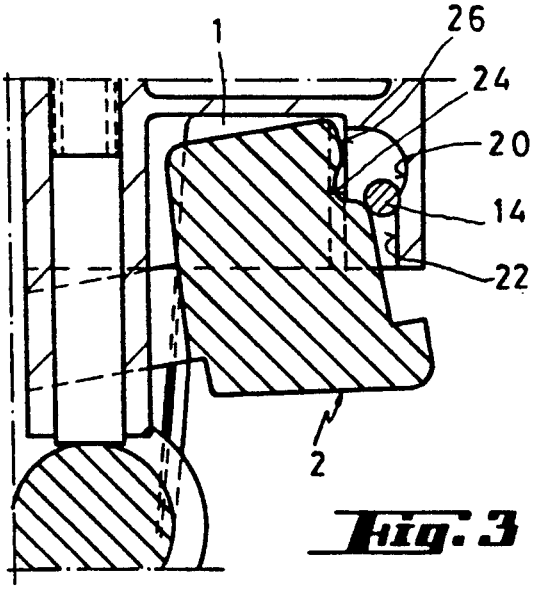
Fig. 3

Fig. 7
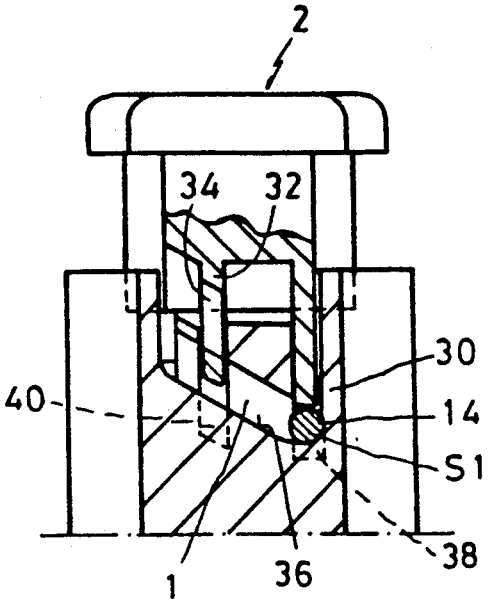
Fig. 8
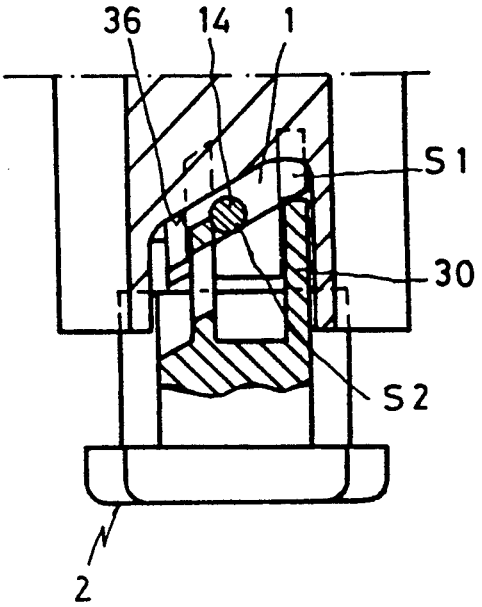
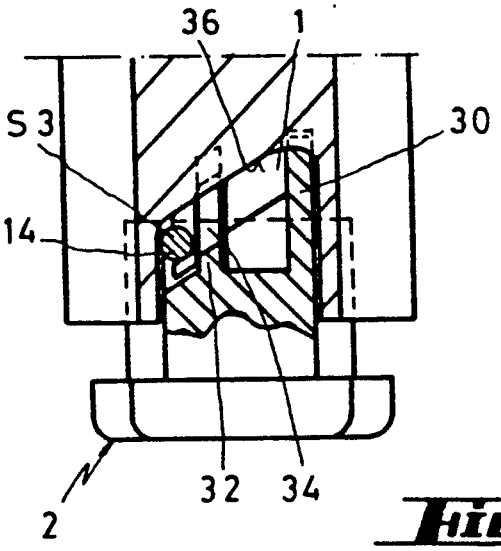
Fig. 9

Fig. 10
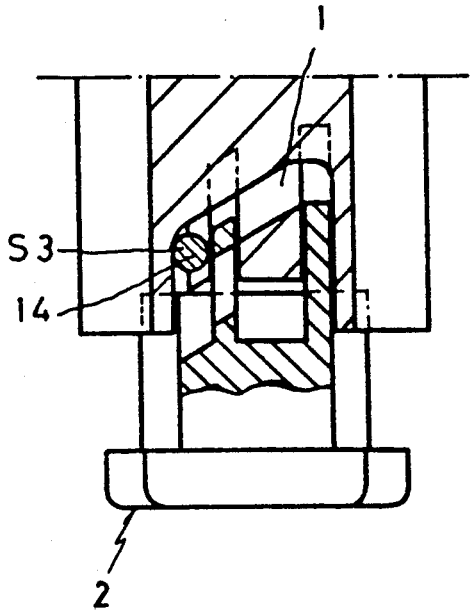
Fig. 11
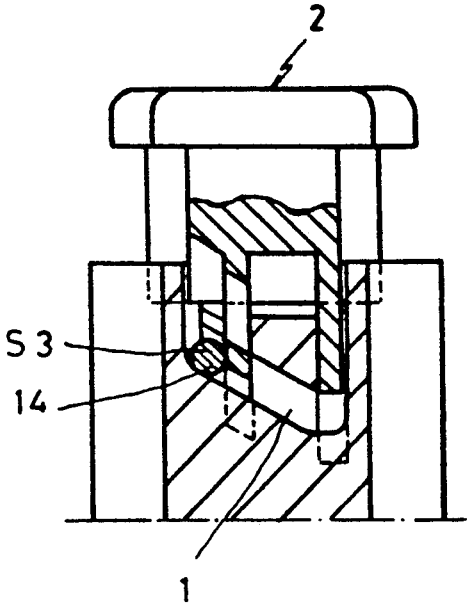
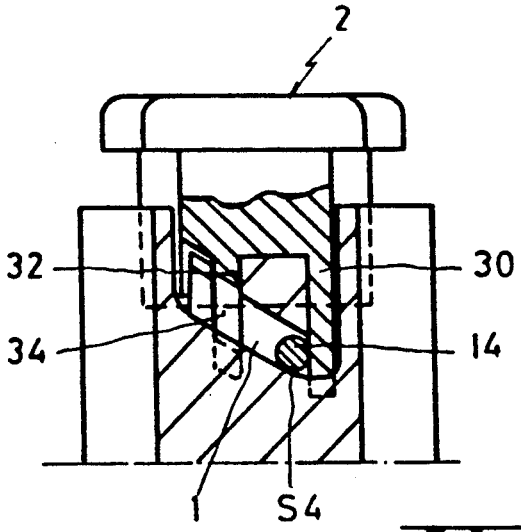
Fig. 12

POCKET LIGHTER HAVING A SAFETY MECHANISM

BACKGROUND OF THE INVENTION

The invention relates to a pocket lighter having a safety mechanism which may be placed, among others, in a first attitude of use and a second substantially reverse attitude vertical to said first attitude. The pocket lighter comprises a push button which, relative to the operation of the lighter, is moveable between an active position to an inactive position which it tends to maintain; and a cavity in which a portion of said push button is contained, the volume and configuration of which vary depending on the position of the push button.

For several years now the majority of developed countries have regulations precisely defining the conditions of lighters so that they may be considered to be reliable products and may be used within a general field of safety, without special risks for the user. A large majority of countries have recently adopted a common standard, ISO 9994, based on a longtime shared experience with the purpose of protecting the user against misfunctioning of the lighter or any manufacturing defect.

Nevertheless, in certain countries, under pressure from consumer organizations, there has recently been a growth in the demand for lighters incorporating properties warding off the risk inherent in the use of a lighter, as a mechanism specially designed to produce a flame, when it is in the hands of inexperienced users, particularly children under 5 years of age.

This initiative is observed in several lines of action from regulations for correct classification, recommendations to manufacturers to incorporate this type of product in their range and information campaigns addressed to the consumers and particularly to sensitize parents with respect to the risk always involved with having uncontrolled lighters in the home.

It should be clarified, however, that the classification of a lighter as "children-safe" will always be relative, since in accordance with the regulations being developed, a lighter will be thus classified in terms of how low the percentage of children capable of producing a flame in a certain time interval under certain test conditions is.

The incorporation of solutions making them difficult to manipulate by children requires an always difficult balance to be achieved, since if the ignition process is not kept easy, the general public and elderly or physically handicapped persons in particular might adopt other alternative always dangerous lighting methods, such as matches for example. It is, therefore, desirable duly to attain this balance such that the actions to be performed to achieve ignition do not require any special ability while not being obvious to children. Nevertheless, since the lighter is an element designed to produce a flame and, therefore, of potentially dangerous effects, parents and tutors are specially recommended to keep lighters of whatsoever type under control and out of reach of children.

There are known mechanisms such as those disclosed in Spanish patent 8902796, or in European patents 0 291 956 and 0 285 748, of Japanese priority, where concealable levers or elements are provided which the user places at will in a push button blocking position or in a position of free operation of the push button, preventing the release of gas in the former position and placing the lighter in disposition to be ignited in the latter. Nevertheless, these mechanisms have the drawback that they are not capable of returning alone to the blocking position after each operation, with a high risk therefore that the user may forget or voluntarily omit this action. Thus the intended protective aim is not attained, with the aggravation that the lighter is provided with safety conditions that it is not capable of guaranteeing.

Also known are mechanisms such as those described in U.S. Pat. No. 4,717,335, where it is proposed to add a shoulder on the drive wheels of the spark producing flint, which when engaging a protuberance on the support thereof, prevent it from rotating completely. Theoretically, each time the flint is used it is necessary to rotate in the opposite direction to be able to relight it. In practice, this design is fairly inefficient since it is frequently possible to obtain a sufficient number of sparks to obtain a flame without requiring a complete rotation of the flint, whereby a further ignition is possible without having to reset the mechanism. Furthermore, the rotation of the flint wheel in the opposite direction is a sufficiently simple operation to be done accidently by a child, whereby the intended purpose is not achieved.

A further step in the evolution are the solutions proposed in European patent 0 357 347, with US priority or in French patent 2,645,626, where there are levers extending outside the lighter accessible to the user and movable between a position in which the push button and, therefore, the gas flow is blocked and another free operation position, capable of resetting themselves alone to the blocking position after each use. These solutions apparently fulfil the required safety task but on the other hand cause greater assembly difficulties, since the space available for housing a new member between the normal lighter operating members is always small. Furthermore, since these levers project to the outside of the lighter it is also easy that when a child is playing with the lighter, the lever may pass accidentally to the operative position with the consequent risk. Since the size of these levers has, of necessity, to be small, it becomes enormously difficult for lighters with these accessories to be used by elderly people or persons with reduced manual capabilities.

SUMMARY OF THE INVENTION

It is an object of the invention to overcome the above mentioned drawbacks. This object is achieved with a lighter of the type described at the beginning which is characterized in that inside said cavity there is a free body movable under gravity and between said cavity and said push button portion, depending on the position of the push button, there are defined: a) spaces stably occupiable by said free body, among which there are, at least, one first blocking space through which said push button portion must of necessity pass for the push button to reach said active position; a second intermediate space, which may be occupied by said free body from said first space when the lighter is placed in the second attitude thereof; and a third space which may be occupied by said free body from said second space, when the push button is placed in the active position thereof and the lighter is held in the second attitude thereof and which, when the push button is placed in the inactive position thereof, becomes a retaining space where said free body is retained when the lighter is place in the first attitude thereof; and b) passages through which said free body may move, among which there are, at least, one first passage extending between said first and second spaces; a second passage extending between said second and third spaces; and a third passage leading from said third space to said first space and which said free body must of necessity move on releasing the push button after operating the lighter, when the latter is in the first attitude of use thereof, such that an orderly succession of variations in the positions of said push button and in attitudes of the lighter means that said free body is alternatively in a push button blocking or push button release position.

It is an object of the invention to overcome the above mentioned drawbacks. This object is achieved with a lighter of the type described at the beginning which is characterized in that inside the cavity there is a free body movable under gravity. Between the cavity and the push button portion, depending on the position of the push button, there are defined at least three spaces stably occupiable by the free body. More specifically, there is at least one first blocking space through which the push button portion must of necessity pass for the push button to reach the active position, a second intermediate space, which may be occupied by the free body from the first space when the lighter is placed in the second attitude thereof and a third space which may be occupied by the free body from the second space when the push button is placed in the active position thereof and the lighter is held in the second attitude thereof. When the push button is placed in the inactive position thereof, the third space becomes a retaining space where the free body is retained when the lighter is placed in the first attitude thereof. The lighter further includes passages through which the free body may move. At least one first passage extends between the first and second spaces; a second passage extends between the second and third spaces; a second passage extends between the second and third spaces; and a third passage extends from the third space to the first space. The free body must of necessity pass through the third passage upon releasing the push button after operating the lighter when the latter is in the first attitude of use thereof. The lighter of the present invention provides an orderly succession of variations in the positions of the push button and in the attitudes of the lighter such that the free body is alternatively in a push button blocking or push button release position.

The present invention overcomes all the above mentioned drawbacks, since:

- it is capable of automatically occupying the blocking position after each operation,
- the release does not require any action on small members or external levers, since these do not exist,
- no special skills are required to release the ignition members, since it is a sequence of very simple movements, but which must of necessity be performed in a particular order,
- it is easily applicable to practically any lighter, since large modifications are not required, either in the component parts or in the complex automatic assembly machinery.

Furthermore, it is sufficient to omit the incorporation of the free body in the assembly process for the lighter to continue being fully operative, having simply lost the safety feature provided by the present invention.

Known anthropometrical studies show the difficulties that children under 5 years of age have for coordinately rotating their arm in a plane in front of the body, since this movement is one of the slowest to be learnt. In this way, there is added to the requirement to perform a certain sequence of movements in a certain order, which movements could still be accidently performed, a notable physical incapability in the case of children, whose protection is the final purpose of the present invention.

Further advantages and features of the invention will be appreciated from the following description in which there is described without any limitative nature, preferred embodiments of the invention with reference to the accompanying drawings.

BRIEF DESCRIPTION OF THE DRAWINGS

FIGS. 1 to 6 show successive schematic view of an operating push button and of a cavity corresponding to one embodiment of the pocket lighter of the invention in which the free body moves from the first blocking space shown in FIG. 1.

FIGS. 7 to 12 are similar views of another embodiment of the invention.

DETAILED DESCRIPTION OF THE INVENTION

Figure 4:
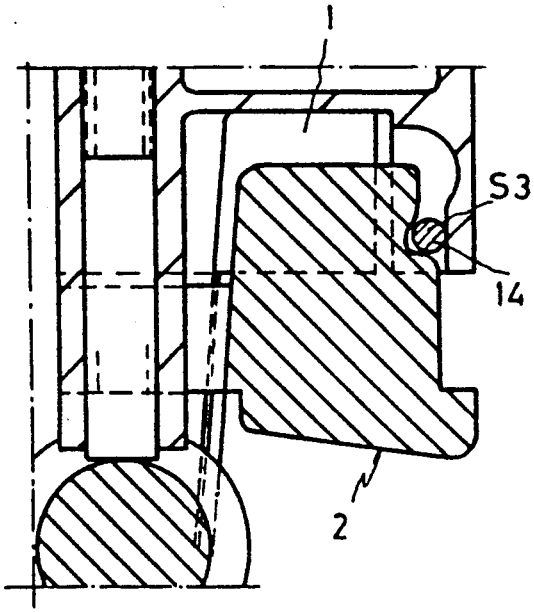
Figure 5:
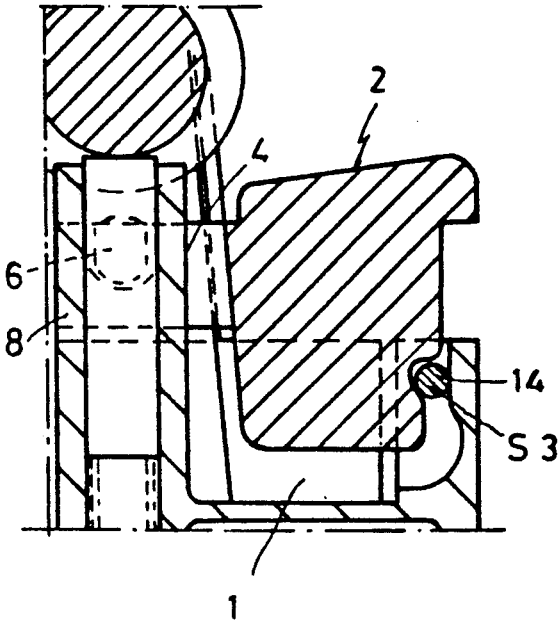

As stated above, FIGS. 1 to 6 show particularly a cavity 1, occupied in part by a portion of a push button 2. This is shown attached to a stem 4 provided with protuberances 6 (FIGS. 5 and 6) whose engagement with the structure 8 allows the push button 2 to oscillate between an inactive position (FIGS. 1, 2, 4 and 5) and an active position (FIGS. 3 and 6) in which the push button 2 is deeper in the cavity 1. In the inactive position, the push button 2 keeps the gas outlet closed while in the active position, it allows the gas out and therefore makes it possible to ignite the lighter. Conventional spring means, not shown, urge the push button 2 to the inactive position. In a known way, the lighter is provided with a knurled wheel 10 capable of producing sparks from a pyrophoric stone 12 by friction and this wheel is usually driven by the user when he moves the push button from the inactive to the active position thereof.

Although the embodiment shown and described is based on a rocking movement of the push button 2, the invention also comprises a movement of translation of the push button. The wheel 10 and flint 12 may also be replaced by a not shown piezoelectric generator.

Reference has been made hereinbefore to the active and inactive positions of the push button 2 and it is obvious that the size and shape of the cavity 1 vary depending on the position of the push button 2. Also, among many other possibilities, the lighter may be placed in a first attitude of use (FIGS. 1, 5 and 6) in which the flame produced by the ignition may emerge vertically above the lighter and a second attitude substantially reversed relative to the said first attitude.

According to the invention, in the cavity 1 there is a free body 14 which is preferably round and more particularly it is spherical or cylindrical. This body may be moved by gravity, logically within the limits determined by the cavity 1 and by the portion of the push button 2 within the cavity.

In the embodiment described, there is to be seen a bottom wall 16 towards which the bush button 2 is moved on passing to the active position thereof. This bottom wall may define a space of maximum depth 17 which may not be reached by the free body 14 due to the existence of an obstacle, such as containing ribs 18, of which only one is shown. Close to the bottom wall 16, the cavity 1 is provided with a lateral concave portion 20 which is terminated at the top end thereof with an advanced surface 22 which follows the concavity 20 in transition therebetween and the exterior of the cavity 1.

In turn, the portion of the push button 2 penetrating in the cavity 1 is provided laterally with a surface depression 24 which is terminated at the lower end thereof with an active surface 26 which follows the depression 24 towards the bottom wall 16 of the cavity 1.

Hereafter, as may be appreciated from the Figures, reference is made to spaces which are defined depending on the position of the push button 2 and which may be occupied by the free body 14 relatively stably. In the Figures, said spaces (possibly occupied by the free body 14) are designated with the letter S followed by a cipher. The said variable positions of the push button 2 and the attitudes of the lighter also define passages between the said spaces.

In FIG. 1 the push button is in the inactive position and the lighter is in the first attitude thereof. Under these conditions, the free body 14 is in a first space S1, which is a blocking space through which the said position of the push button 2 must of necessity pass for the push button to reach the active position. Obviously, the occupation of the free space S1 by the free body 14 prevents the push button from occupying the active position and, therefore, the lighter may not be ignited.

When the lighter is moved to the second attitude while the push button is still in the inactive position, the situation shown in FIG. 2 is reached in which, by gravity, the free body 14 comes out of the space S1 and occupies a second intermediate space S2 which is comprised between the active surface 26 of the push button 2 and the lateral concave portion 20 of the cavity 1. Between the space S1 and the space S2 there extends a first passage delimited by the lateral concave portion 20 and the push button 2.

In this situation, the push button 2 becomes released and, therefore, may pass to the active position, as shown in FIG. 3. In this new situation it is the lateral depression 24 (and not the active surface 26) which faces the lateral concave portion 20.

Therefore, while the lighter is held in the second attitude thereof and the push button 2 is allowed to recover the inactive position thereof (FIG. 4) the free body 14 (through short second passage) occupies a third space S3 which is a retaining space, since the free body 14 is stably retained between the advanced surface 22 of the cavity 1 and the lateral depression 24 of the push button 2.

Figure 6:
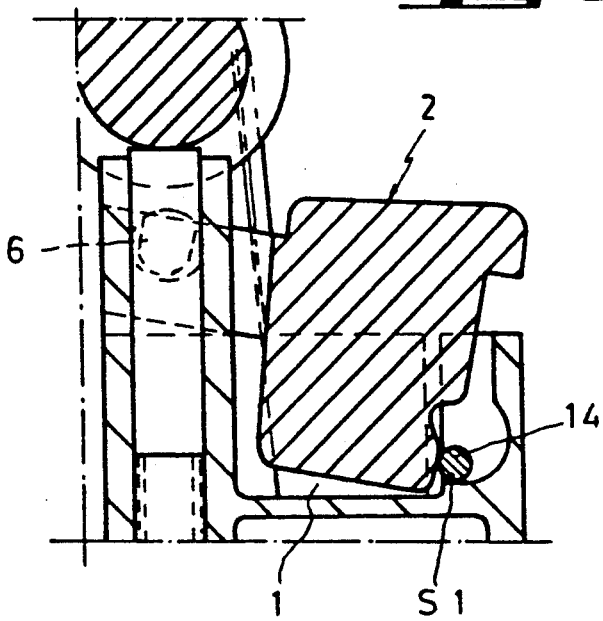
Figure 13:
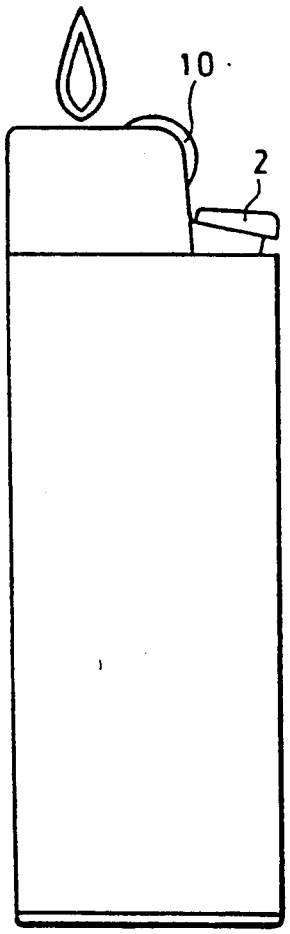
FIG. 13 is an elevation view of a lighter in the first attitude of use, with flame.
Figure 14:
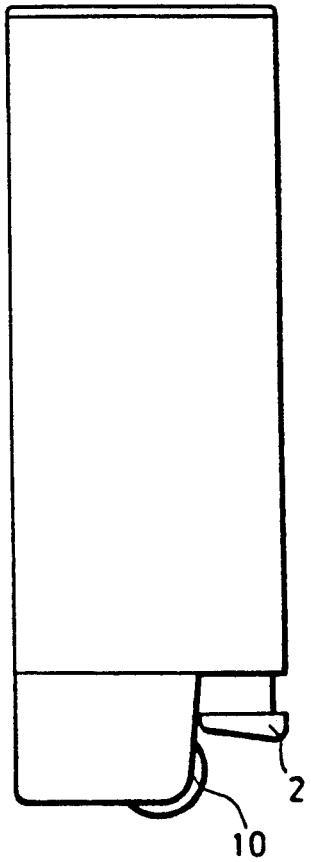
FIG. 14 is an elevation view of the same lighter in the second attitude thereof, substantially vertically reversed to the first attitude.

This means that when the lighter is returned to the first attitude thereof and without operating the push button 2 (FIG. 5), the free body 14 remains in the space S3. Therefore, the push button 2 is no longer blocked and the lighter is ready for use, as shown in FIG. 6.

As may be seen, when the push button is pressed to the active position thereof, the free body 14 comes out of the space S3 and (through a third passage) returns to the space S1, where it remains when the push button returns to the inactive position, i.e. the blocking position of FIG. 1 is automatically attained when the push button is released, after using the lighter.

FIGS. 7 to 12 shown another embodiment of the lighter of the invention. On describing this new embodiment, as far as possible, the same reference symbols have been given to members like those of the previous embodiment. In this new embodiment there is also a cavity 1 in which there is a free body 14 and which is partially occupied by a portion of a push button 2 which, in this embodiment, moves between the active position and the inactive position by a movement of translation, although the invention also contemplates the possibility of the push button 2 making a rocking movement. The inactive position (in which it tends to remain) is shown in FIGS. 7, 8, 10 and 11 and the active position in FIGS. 9 and 12.

As in the previous case, here also the size and shape of the cavity 1 vary in dependence of the position of the push button 2. Furthermore, the paragraphs relating to the first and second attitudes of the lighter are deemed to be reproduced here.

In the embodiment of FIGS. 7-12, the push button 2 is provided with a main appendix 30 and an intermediate appendix 32 emerging from the underside of the push button. The latter appendix is provided with an aperture 34 in the center thereof and the dimensions of the aperture are sufficient to allow the free body 14 to pass therethrough.

In turn the cavity 1 is provided with a sloping bottom wall 36 which, in the first attitude of the lighter, defines a lowermost portion which must be occupied by the main appendix 30 when the push button 2 is in the active position thereof. In this lowermost portion there preferably starts a first hollow 38 which is inaccessible to the free body 14 and in which the main appendix will enter in the active position of the push button 2.

In an intermediate portion of the bottom wall 36, there is a second hollow adapted to receive the intermediate appendix 32 to a distance sufficient for the aperture 34 to be flush with the bottom wall 36.

In FIG. 7, the push button 2 is in the inactive position and the lighter in the first attitude thereof. Therefore, the free body 14 occupies the first space S1 (blocking space), in which the push button is prevented from reaching the active position thereof.

When the lighter is placed in the second attitude thereof (FIG. 8) and the push button is kept in the inactive position, the free body 14 falls out of the space S1 and moves through a first passage to occupy a second intermediate space S2, which is defined by the bottom wall 36 and the intermediate appendix 32. In this situation, the push button is no longer blocked and may consequently pass to the active position (FIG. 9).

In this new situation (lighter in the second attitude and push button in active position), the aperture 34 of the appendix 32 is flush with the bottom wall 36 which allows the free body 14 to fall through the aperture 34, so that it occupies a third position S3 after moving through a second passage.

While the lighter is held in the second attitude thereof and the push button is moved to the inactive position thereof (FIG. 10), the third space S3 becomes a retaining space, where the free body 14 remains although the lighter is returned to the first attitude of use thereof, as appreciated in FIG. 11.

In this case, the push button is unblocked and the lighter may be used, as shown in FIG. 12, where the push button has been moved to an active position. Therewith, the free body 14 comes out of the space S3 through a third passage (equivalent substantially to the succession of the second and first space) and while the push button is in the active position it remains in a fourth space S4, to return to the first space S1 when the push button returns to the inactive position. As in the previous case, it should also be pointed out that here also the blocking position of FIG. 7 is automatically attained when the push button 2 is released after operating the lighter.

The reference signs inserted after the technical features mentioned in the claims have the sole purpose of facilitating the understanding thereof and not of limiting their scope in any way.

What we claim is:

1. A pocket lighter which can be moved between upright and inverted positions comprising:

a push button moveable between an active position and an inactive position, an inclined cavity operatively interconnected with the push button, a free body inside said cavity and being moveable therein under gravity between three stable occupiable spaces within said cavity depending on the position of the push button and the position of the lighter, a first blocking space defined at a first location in said cavity, a third retaining space defined at a third location in said cavity, said third location being above said first location, and a second intermediate space defined at a second location in said cavity between said first and third locations, said free body being in a push button blocking position when said lighter is upright and said free body occupies the first space, said free body being moveable from said first space to said second space when said lighter is placed in the inverted position, said third space can be occupied by said free body from said second space when the push button is placed in the active position and said lighter remains inverted, said free body being retained in said third space when the push button is placed in the inactive position, said free body remaining in said third space when said lighter is returned to the upright position thereby placing said free body in a push button release position, said free body returning to said first space after operating the lighter by placing said push button in the active position when said lighter is in the upright position, the above succession of positions of said push button and the positions of the lighter resulting in the free body being moveable between a push button blocking and push button releasing position.

2. The lighter of claim 1 wherein said free body is a round body, preferably a sphere or a cylinder.

3. The lighter of claim 1, further including first, second, and third passages in said cavity through which said free body can move, said first passage extending between said first and second spaces, said second passage extending between said second and third spaces and said third passage extending from said third space to said first space.

4. The lighter of claim 3, wherein said third passage is substantially formed by the succession of said second and third passages.

5. The lighter of claim 1, wherein:

said cavity includes a bottom wall defining a space of maximum depth and a rib at one end thereof, a lateral concave portion adjacent said rib followed by an advanced surface, a portion of said push button includes a lateral surface depression and an adjacent active surface which extends toward the bottom wall of the cavity, the portion of the push button being disposed in the cavity, when said push button is in said inactive position said depression and said active surface substantially facing said advanced surface and said concave portion respectively, when said push button is in said active position said depression is substantially at the level of said concave portion, said first blocking space being defined between the push button and the rib, said second intermediate space defined between the active surface and the concave portion and the third retaining space defined between the depression and the advanced surface.

6. The lighter of claim 5 wherein the push button moves between said first and second positions by rocking or a movement of translation.

7. The lighter of claim 1 further including a fourth space defined at a fourth location in said cavity, said fourth location located immediate to said first blocking space, wherein said free body is movable from said third apace to said fourth space when said push button is placed in the active position thereof and said lighter is in said upright position.

8. The lighter of claim 7 wherein:

said cavity includes a sloping bottom wall having a lowermost portion thereof and including a first lower hollow located at said lowermost portion thereof, and a second lower hollow located at an intermediate portion of said bottom wall;

a portion of said push button including a lower main appendix and an intermediate appendix each extending from said push button, said main appendix occupying said lowermost portion of said cavity when said lighter is in said upright position and said push button is in said active position, said intermediate appendix provided with an aperture of a dimension sufficient to allow said free body to pass therethrough and adapted to penetrate said second hollow until said aperture is flush with said sloping bottom wall of said cavity when said push button is in said active position;

said first blocking space being defined between said main appendix and said lowermost portion of said bottom wall, said second intermediate space is defined between said main appendix and said intermediate appendix when said push button is in said inactive position, and said third retaining space is defined adjacent said intermediate appendix at a side opposite said main appendix when said push button is in said active position.

9. The lighter of claim 8 wherein said first lower hollow is inaccessible to said free body, said main appendix adapted to penetrate said first lower hollow when said push button is in said active position.

10. The lighter of claim 9 wherein the push button moves between said first and second positions by rocking.

11. A pocket lighter having a safety mechanism and can be placed in a first attitude of use and a second substantially reverse attitude vertical to said first attitude comprising:

a cavity having a bottom wall defining a space of maximum depth and a rib at one end thereof, a lateral concave portion adjacent said rib followed by an advanced surface, a push button moveable between an active position and an inactive position, a portion of said push button includes a lateral surface depression and an adjacent active surface which extends toward the bottom wall of the cavity, when said push button is in said inactive position said depression and said active surface substantially facing said advanced surface and said concave portion respectively, when said push button is in said active position said depression is substantially at the level of said concave portion, a free body inside said cavity and moveable under gravity between three stable occupiable spaces depending on the position of the push button and the attitude of the lighter, a first blocking space defined between the push button and the rib, a second intermediate space defined between the push button and the rib, a second intermediate space defined between the active surface and the concave portion and a third retaining space defined between said depression and the advanced surface, first, second, and third passages through which said free body can move, said first passage extending between said first and second spaces, said second passage extending between said second and third spaces and said third passage extending from said third space to said first space, said free body being in a push button blocking position when said lighter is in said first attitude, said push button is in the inactive position and said free body occupies the first space, said free body being moveable from said first space to said second space when said lighter is placed in a second attitude, said third space can be occupied by said free body from said second space when the push button is placed in the active position and said lighter remains in the second attitude, said free body being retained in said third space when the push button is placed in the inactive position, said free body remaining in said third space when said lighter is returned to the first attitude thereby placing said free body in a push button release position, said free body returning to said first space after operating the lighter by placing said push button in the active position when said lighter is in said first attitude, the above succession of positions of said push button and the attitudes of the lighter resulting in the free body being moveable between a push button blocking and a push button releasing position.

12. The lighter of claim 11, wherein the push button moves between the first and second positions by rocking.

* * * * *